US010704157B2

(12) United States Patent
Chaleix et al.

(10) Patent No.: US 10,704,157 B2
(45) Date of Patent: Jul. 7, 2020

(54) SOLUTION FOR REDUCING THE BLACKENING OR TARNISHING OF A METAL SHEET AND METAL SHEET

(75) Inventors: Daniel Chaleix, Verny (FR); Christian Allely, Metz (FR); Maxime Monnoyer, Audun le Roman (FR); Pascale Feltin, Saint Privat la Montagne (FR)

(73) Assignee: ARCELORMITTAL INVESTIGACIÓN Y DESARROLLO, S.L., Sestao Bizkaia (ES)

( * ) Notice: Subject to any disclaimer, the term of this patent is extended or adjusted under 35 U.S.C. 154(b) by 1212 days.

(21) Appl. No.: 14/371,642

(22) PCT Filed: Jan. 10, 2012

(86) PCT No.: PCT/FR2012/000013
§ 371 (c)(1),
(2), (4) Date: Nov. 12, 2014

(87) PCT Pub. No.: WO2013/104835
PCT Pub. Date: Jul. 18, 2013

(65) Prior Publication Data
US 2015/0093594 A1 Apr. 2, 2015

(51) Int. Cl.
*C23C 22/68* (2006.01)
*C23C 22/53* (2006.01)
(Continued)

(52) U.S. Cl.
CPC ..... *C25D 11/34* (2013.01); *C23C 22/53* (2013.01); *C23C 22/68* (2013.01); *C25D 5/48* (2013.01); *Y10T 428/1266* (2015.01)

(58) Field of Classification Search
CPC ... C23C 22/68; C25D 11/00–02; C25D 11/26; C25D 11/34
See application file for complete search history.

(56) References Cited

U.S. PATENT DOCUMENTS 6,235,410 B1 * 5/2001 Komatsu ..... C23C 2/06 428/659
6,528,182 B1 3/2003 Bello et al.
(Continued)

FOREIGN PATENT DOCUMENTS

JP S59177381 A 10/1984
JP 2007204769 A 8/2007
(Continued)

OTHER PUBLICATIONS

Volovitch P. et al. "Understanding corrosion via corrosion product characterization: II. Role of alloying elements in improving the corrosion resistance of Zn-Al-Mg coatings on steel." Corrosion Science: Oxford, GB. vol. 53, No. 8, Mar. 17, 2011: pp. 2437-2445. XP028373751, ISSN: 0010-938X, DOI: 10.1016.

*Primary Examiner* — Lois L Zheng
(74) *Attorney, Agent, or Firm* — Davidson, Davidson & Kappel, LLC

(57) ABSTRACT

The present invention provides an aqueous treatment solution containing sulfate ions $SO_4^{2-}$ in a concentration greater than or equal to 0.01 mol/l, to treat sheet metal including a steel substrate coated on at least one face with a coating including at least zinc and magnesium to reduce blackening or tarnishing of the sheet metal during storage. The present invention also provides a sheet metal treated with a solution of this type.

30 Claims, 4 Drawing Sheets

(51) Int. Cl.

| | |
|---|---|
| ***C25D 11/34*** | (2006.01) |
| ***C25D 5/48*** | (2006.01) |
| *C23C 22/00* | (2006.01) |
| *C25D 11/02* | (2006.01) |

(56) References Cited

U.S. PATENT DOCUMENTS

| | | | | |
|---|---|---|---|---|
| 6,607,844 | B1 * | 8/2003 | Araga ..... | C25D 3/565<br>428/624 |
| 2008/0308192 | A1 | 12/2008 | Bello et al. | |
| 2009/0110921 | A1 | 4/2009 | Kaneto et al. | |
| 2013/0160898 | A1 | 6/2013 | Matsuno et al. | |

FOREIGN PATENT DOCUMENTS

| | | | |
|---|---|---|---|
| RU | 2387738 | C | 4/2010 |
| WO | 0015878 | A1 | 3/2000 |
| WO | 2005071140 | A1 | 8/2005 |
| WO | 2011158513 | A1 | 8/2013 |

* cited by examiner

SOLUTION FOR REDUCING THE BLACKENING OR TARNISHING OF A METAL SHEET AND METAL SHEET

The present invention relates to sheet metal comprising a steel substrate that is coated on at least one face with a coating comprising zinc and magnesium.

Sheet metal of this type is intended in particular to be used for the fabrication of parts for automobiles, although it is not limited to those applications.

BACKGROUND

Coatings that consist essentially of zinc are conventionally used for the effective protection they provide against corrosion, whether in the automobile sector or in construction, for example. However, these coatings cause weldability problems and are currently in competition with coatings that contain zinc and magnesium.

The addition of magnesium significantly increases the resistance of these coatings to perforating corrosion, and can make it possible to reduce the thickness of these coatings and thus improve their suitability for welding, or also to maintain the thickness of the coating and increase the guaranteed protection against corrosion over time.

In addition, the improvement of the resistance to corrosion is such that it is currently possible to reduce or even to eliminate the use of secondary protection measures such as the use of waxes or mastics in the locations that are the most susceptible to corrosion.

However, coils of sheet with surface coatings of this type can sometimes remain in storage facilities for many months before they are shaped by the final user, during which time this surface must not be altered by the appearance of surface corrosion. In particular, no corrosion may appear, whatever the storage environment, even if the sheet metal is exposed to sun and/or to a moist or even saline environment.

Standard galvanized products, i.e., products whose coatings consist essentially of zinc, are also subject to these constraints and are coated with a protective oil, which is generally sufficient.

BRIEF SUMMARY OF THE INVENTION

The inventors, however, have found that, in the event of the dewetting of this protective oil, the coatings that contain zinc and magnesium exhibit slight surface oxidation during storage which modifies the interaction of light with the surface and thereby modifies its visual appearance.

In that case, the appearance of black spots has been noted for coatings that contain zinc and magnesium, whereby this phenomenon is designated by the term blackening. For coatings that contain zinc, magnesium and aluminum, the entire surface that is not coated with oil becomes tarnished, in which case the phenomenon is referred to as tarnishing.

In addition, the use of a temporary protection oil is rather constraining because, on the one hand, the oil tends to contaminate the working environment and the tools used to cut and shape the coils of sheet metal, and on the other hand a degreasing process is frequently necessary in a subsequent step of the fabrication of the parts that originate from these coils.

Therefore, there is a requirement for the development of a temporary protection system for these coatings, in particular with regard to blackening and tarnishing phenomena, a system which must be effective even in the absence of temporary protection oil.

For this purpose, a first object of the invention is to reduce blackening or tarnishing of the steel sheet during storage. The present invention provides using an aqueous treatment solution containing sulfate ions $SO_4^{2-}$ in a concentration greater than or equal to 0.01 mol/l, to treat a steel sheet comprising a substrate of steel coated on at least one face with a coating comprising at least zinc and magnesium to reduce blackening or tarnishing of the steel sheet during storage.

The present invention may also include the following characteristics, individually or in combination:

- the coating comprises at least zinc, magnesium and aluminum;
- the pH of the aqueous treatment solution is between 5 and 7;
- the aqueous treatment solution also contains $Zn^{2+}$ ions in a concentration greater than or equal to 0.01 mol/l;
- the concentration of $Zn^{2+}$ ions and the concentration of $SO_4^{2-}$ ions in the aqueous treatment solution is between 0.07 and 0.55 mol/l;
- the aqueous treatment solution is applied to the coating under conditions of temperature, contact time with the coating, concentration of $SO_4^{2-}$ ions and $Zn^{2+}$ ions adjusted to form a zinc hydroxysulfate/zinc sulfate-based temporary protection layer, the quantity of sulfur in which is greater than or equal to 0.5 mg/m$^2$ and less than or equal to 30 mg/m$^2$;
- the aqueous treatment solution is applied to the coating under conditions of temperature, contact time with the coating, concentration of $SO_4^{2-}$ ions and $Zn^{2+}$ ions adjusted to form a zinc hydroxysulfate/zinc sulfate-based temporary protection layer having a sulfur content between 3.7 and 27 mg/m$^2$;
- after the application of the aqueous treatment solution to the coating, the sheet is dried, after optionally having been rinsed;
- the aqueous treatment solution is applied under anodic polarization and the pH of the aqueous treatment solution is greater than or equal to 12 and less than 13;
- the concentration of $SO_4^{2-}$ ions is greater than 0.07 mol/l;
- the density of electric charges flowing during the treatment through the coating is adjusted to form a zinc hydroxysulfate/zinc sulfate-based temporary protection layer, the sulfur content of which is greater than or equal to 0.5 mg/m$^2$ and less than or equal to 30 mg/m$^2$;
- the density of electric charges is adjusted to form a zinc hydroxysulfate/zinc sulfate-based temporary protection layer, the sulfur content of which is between 3.7 and 27 mg/m$^2$;
- the polarization current density applied during the treatment is greater than 20 A/dm$^2$; and
- after the application of the aqueous treatment solution on the coating, the sheet is rinsed.

The present invention also provides a sheet metal. The sheet metal comprises a steel substrate and a coating covering at least one face of the substrate. The coating comprises zinc, magnesium and aluminum. The sheet metal also comprises a zinc hydroxysulfate/zinc sulfate-based temporary protection layer, the sulfur content of which is greater than or equal to 0.5 mg/m$^2$ and less than or equal to 30 mg/m$^2$. The temporary protection layer is applied over the coating.

The sheet metal of the present invention may also include the following characteristics, individually or in combination:

- the temporary protection layer contains a quantity of sulfur greater than or equal to 3.7 mg/m$^2$ and less than or equal to 27 mg/m$^2$;

the coating comprises between 0.1 and 10% by weight magnesium and between 0.1 and 20% by weight aluminum; and the coating comprises between 2 and 4% by weight magnesium and between 2 and 6% by weight aluminum.

Other characteristics and advantages of the present invention are described in greater detail below, whereby this description is provided solely by way of example and is in no way restrictive.

BRIEF DESCRIPTION OF THE DRAWINGS

This present invention is explained in greater detail by examples shown without being restrictive, and with reference to the accompanying drawings in which.

DETAILED DESCRIPTION

Figure 1:
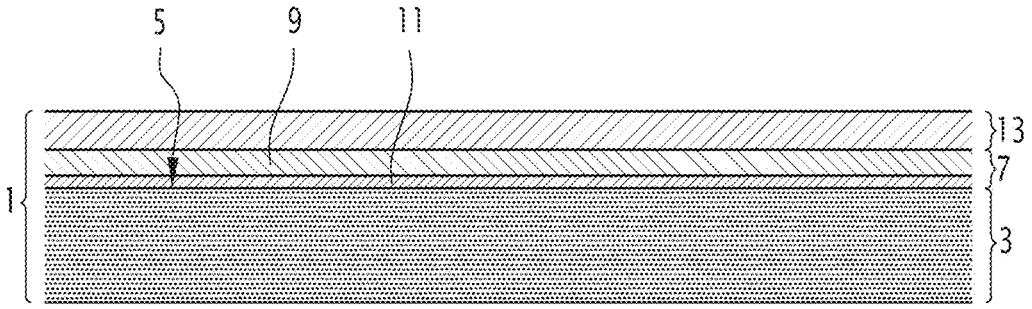
FIG. 1 is a schematic sectional view illustrating the structure of the steel according to the present invention.

The sheet metal 1 in FIG. 1 comprises a steel substrate 3, preferably hot-rolled and then cold-rolled, and can be coiled, for example, for later use as a part for an automobile body.

However, the invention is not limited to this field and can also be used for any steel part, regardless of its intended final use.

In this example, the sheet metal 1 is then unwound from the coil, then cut and shaped to form a part.

The substrate 3 is coated on one face 5 with a coating 7. In certain variants, a coating 7 of this type can be present on both faces of the substrate 3.

The coating 7 comprises at least one zinc-based layer 9. The layer 9 preferably comprises from, for example, 0.1 to 20% by weight magnesium.

This layer 9 generally has a thickness of less than or equal to 20 μm and is intended for the purpose of protecting the substrate 3 against perforating corrosion, in the conventional manner. It should be noted that the relative thicknesses of the substrate 3 and of the different layers that coat it are not drawn to scale in FIG. 1 to make the illustration easier to interpret.

The layer 9 comprises at least 0.1% by weight magnesium, because below that amount, no corrosion protection effect is visible.

In one preferred embodiment, the layer 9 contains at least 0.5% and preferably at least 2% by weight magnesium.

The magnesium content is limited to 20% by weight in the layer 9 because it has been observed that a higher proportion would result in the excessively rapid consumption of the coating 7 and thus paradoxically in a degradation of the anti-corrosion action.

The layer 9 can in particular be deposited using a vacuum deposition process, for example, by means of magnetron sputtering or vacuum evaporation via the Joule effect, by induction or by an electron beam.

In this preferred embodiment, the layer 9 generally comprises only zinc and magnesium, although other elements such as aluminum or silicon can be added if necessary to improve other characteristics of the layer 9 such as its ductility or adherence to the substrate 3.

When the layer 9 contains only zinc and magnesium, particular preference is given to a magnesium content in the layer 9 of between 14 and 18% by weight, and the results are improved if the majority of the layer corresponds to the intermetallic compound having the formula $Zn_2Mg$, containing approximately 16% by weight magnesium, for example, which has particularly good properties in terms of resistance to perforating corrosion.

In other preferred embodiments, the coating 7 can include a layer 11 of zinc between the layer 9 and the face 5 of the substrate 3. This layer 11 may be applied, for example, by a vacuum deposition or electrodeposition method.

In these preferred embodiments, magnesium may be deposited under vacuum on zinc previously deposited by electrodeposition on the substrate 3. A heat treatment is performed to alloy the magnesium and the zinc that have been deposited and thereby form a layer 9 that contains zinc and magnesium on top of the layer 11 that contains zinc.

When the layer 9 contains zinc, magnesium and aluminum, it is particularly preferred if the layer 9 comprises, for example, between 0.1 and 10% by weight magnesium and between 0.1 and 20% by weight aluminum. Again preferably, the layer 9 comprises between 2 and 4% by weight magnesium and between 2 and 6% by weight aluminum, for example, and it is therefore close to the composition of the ternary eutectic zinc/aluminum/magnesium.

In this embodiment, the layer 9 can be obtained by a hot-dip coating process in a bath of molten zinc containing, for example, magnesium up to a content of 10% by weight and aluminum up to a content of 20% by weight. The bath can also contain up to 0.3% by weight of optional additional elements such as Si, Sb, Pb, Ti, Ca, Mn, Sn, La, Ce, Cr, Ni, Zr or Bi, for example.

These different elements can, among other things, improve the ductility or the adherence of the layer 9 to the substrate 3. A person skilled in the art who is familiar with their effects on the characteristics of the layer 9 will know how to use them as a function of the additional purpose sought. Finally, the bath can contain residual elements contained in the original ingots that were melted or resulting from the passage of the substrate 3 through the bath.

The coating 7 is covered by a temporary protection layer 13.

The layer 13 has been obtained, for example, by the application to the coating 7, after degreasing if necessary, of an aqueous treatment solution containing sulfate ions $SO_4^{2-}$ in a concentration greater than or equal to 0.01 mol/l. The layer 13 thus formed is based on zinc hydroxysulfate and zinc sulfate. It is both sufficiently thick and adherent.

It is not possible to form such a layer 13 when the concentration of $SO_4^{2-}$ is less than 0.01 mol/l, but it has also been found that too high a concentration does not significantly improve the rate of deposition and may even slightly reduce it.

The aqueous treatment solution is applied in the conventional manner, e.g., by dipping, spraying or coating.

In one preferred embodiment, the aqueous treatment solution also contains $Zn^{2+}$ ions in a concentration greater than or equal to 0.01 mol/l, which makes it possible to obtain a more uniform deposition.

For example, the aqueous treatment solution can be prepared by dissolving zinc sulfate in pure water. For example, zinc sulfate heptahydrate ($ZnSO_4$, 7 $H_2O$) can be used. The concentration of $Zn^{2+}$ ions is then equal to the concentration of $SO_4^{2-}$ anions.

The pH of the aqueous treatment solution preferably corresponds to the natural pH of the solution, without the addition of either base or acid. The value of this pH is generally between 5 and 7.

The aqueous treatment solution is preferably applied to the coating 7 under conditions of temperature, contact time with the coating 7, concentration of $SO_4^{2-}$ ions and $Zn^{2+}$ ions adjusted so that the layer 13 contains a quantity of sulfur greater than or equal to 0.5 mg/m$^2$.

The contact time of the aqueous treatment solution with the coating 7 is preferably between 2 seconds and 2 minutes and the temperature of the aqueous treatment solution is between 20 and 60° C., for example.

The aqueous treatment solution used preferably contains between 20 and 160 g/l of zinc sulfate heptahydrate, which corresponds to a concentration of $Zn^{2+}$ ions and a concentration of $SO_4^{2-}$ ions between 0.07 and 0.55 mol/l. It has been found that in this range of concentration the rate of deposition is not significantly influenced by the value of the concentration.

The aqueous treatment solution is advantageously applied under conditions of temperature, contact time with the coating 7 and concentrations of ions $SO_4^{2-}$ and $Zn^{2+}$ ions adjusted to form a layer 13 that contains a quantity of sulfur between 3.7 and 27 mg/m$^2$.

In one preferred embodiment of the invention, the aqueous treatment solution contains an agent that oxidizes zinc, such as hydrogen peroxide. This oxidizing agent can have a very pronounced sulfation/hydroxysulfation accelerator effect at a low concentration. It has been found that the addition of only 0.03%, i.e., $8\times10^{-3}$ mol/liter of hydrogen peroxide or 2×10 mol/liter of potassium permanganate in the solution makes it possible to (approximately) double the rate of deposition. On the other hand, it has been found that concentrations 100 times greater no longer make it possible to achieve this improvement of the deposition rate.

After application of the aqueous treatment solution and before drying, the layer 13 deposited is adherent. The drying is adjusted to eliminate the residual liquid water from the deposit.

Between the application step and the drying step, the sheet 1 is preferably rinsed to eliminate the soluble portion of the deposit obtained. The absence of rinsing and the obtaining of a resulting deposit that is partly soluble in water are not very detrimental to the reduction of the degradation of the coating 7 during the subsequent forming of the sheet 1, since the deposit obtained does indeed comprise a water-insoluble layer 13.

In an additional embodiment of the invention, the aqueous treatment solution contains a concentration of $SO_4^{2-}$ ions greater than or equal to 0.01 mol/l and is applied under anodic polarization, and the pH of the aqueous treatment solution is greater than or equal to 12 and less than 13.

If the pH of the solution is less than 12, adherent hydroxysulfates are not formed on the surface to be treated. If the pH of the solution is greater than or equal to 13, the hydroxysulfate re-dissolves and/or decomposes into zinc hydroxides.

When sodium sulfate is used in the aqueous treatment solution, little formation of hydroxysulfates on the surface is observed if the sodium sulfate concentration is less than 1.42 g/l in the solution. This concentration is equivalent to 0.01 mol/l of $SO_4^{2-}$, and more generally it is important for the concentration of $SO_4^{2-}$ ions to be greater than or equal to 0.01 mol/l and preferably greater than or equal to 0.07 mol/l.

Furthermore, the concentration of sulfate ions is preferably less than or equal to 1 mol/liter. If sodium sulfate is used in concentrations greater than 142 g/l, e.g., 180 g/l, a reduction in the efficiency of the formation of the layer 13 is observed.

Preferably, the total quantity of hydroxysulfates and sulfates deposited should be greater than or equal to 0.5 mg/m$^2$ and less than or equal to 30 mg/m$^2$ of equivalent sulfur, preferably between 3.5 and 27 mg/m$^2$ of equivalent sulfur.

Preferably, the applied charge density is between 10 and 100 C/dm$^2$ of surface to be treated.

Preferably, the deposition of the zinc hydroxysulfate/zinc sulfate-based layer 13 is performed under a high polarization current density, in particular greater than 20 A/dm$^2$ and, for example, 200 A/dm$^2$.

A titanium cathode, for example, can be used as the auxiliary electrode.

The temperature of the aqueous treatment solution is generally between 20° C. and 60° C. Preferably, the process is carried out at a temperature greater than or equal to 40° C., to increase the conductivity of the solution and to reduce ohmic losses.

After the formation of the layer 13 in accordance with this other embodiment, the treated surface is thoroughly rinsed with demineralized water. This rinsing step makes it possible to eliminate the alkaline reactants on the surface of the deposit, reactants that might cause corrosion problems.

After the formation of the layer 13 on the surface according to one of the methods described above, the layer 13 of the sheet 1 can optionally be lubricated.

This lubrication can be performed by applying a film of oil with a weight of less than 2 g/m$^2$ on the layer 13.

As will be seen in the following non-restrictive examples, which are presented by way of illustration, the inventors have shown that the presence of a layer 13 makes it possible to improve the resistance to blackening in the case of a coating 7 that contains zinc and magnesium and to improve the resistance to tarnishing if the coating 7 contains zinc, magnesium and aluminum. This increased resistance is particularly useful in the case of the absence of an oil film, for example as the result of the dewetting of a film of oil applied on the coating 7.

This increase of resistance to blackening and tarnishing is due essentially to the formation of a conversion layer based on zinc hydroxysulfate $Zn_4SO_4(OH)_6$.

The reactions involved in the application of the aqueous treatment solution to the coating 7 include:

1. Acid attack of the metallic zinc ($SO_4^{2-}$ solution at a pH between 5 and 7), which results in the formation of $Zn^{2+}$ ions and the alkalinization of the medium: $Zn+2H_2O \rightarrow Zn^{2+}+2OH^-+H_2$.

2. Precipitation of zinc hydroxysulfate under the effect of the accumulation of $Zn^{2+}$ and $OH^-$ ions in the sulfate solution: $4\ Zn^{2+}+SO_4^{2-}+6\ OH^- \rightarrow Zn_4SO_4(OH)_6$.

Compared to a coating that does not contain zinc, the presence of magnesium in the coating 7 contributes to stabilizing the layer of zinc hydroxysulfate over time and therefore to the prevention of its transformation into zinc carbonate under the effect of atmospheric $CO_2$. It is known that zinc carbonates offer less protection (less barrier) than zinc hydroxysulfates.

Resistance to Blackening:

Test pieces are cut from two types of sheet 1, namely:

sheet 1, the coating 7 of which comprises a layer 11 of zinc 5.5 μm thick and a layer 9 with a thickness of 3.5 μm, whereby the layer 9 consists of approximately 84% by weight zinc and 16% by weight magnesium. To produce these layers, first a 7.5 μm layer of zinc is deposited by electrodeposition and a 1.5 μm layer of magnesium by vacuum deposition and the sheet metal is subjected to a heat treatment to alloy the magnesium and the zinc. These test pieces will be designated ZEMg below; and sheet 1, the coating 7 of which comprises a layer 11 of zinc 4 μm thick applied by vacuum deposition and a layer 9 with a thickness of 3.5 μm applied by vacuum deposition and comprising approximately 80% by weight zinc and 20% by weight magnesium. These test pieces will be designated ZnMg FULL PVD below.

The substrate 3 of the ZEMg and ZnMgFullPVD test pieces is a cold rolled steel for deep drawing.

Some of the test pieces were coated with a layer 13 having a weight between 17 and 20 mg/m$^2$ of sulfur.

The application conditions to form the layer 13 were as follows:

Application method=Spin Coater at a speed of 700 RPM for 15 seconds,

Concentration of the solution=40 g/L of zinc sulfate heptahydrate pH of the solution=5

Temperature of solution=Ambient,

Drying=by bringing the test pieces to a temperature between 70 and 80° C.

The temporary protection of the test pieces was evaluated by a test performed in humidity and temperature controlled corrosion-test chamber, as specified by DIN EN ISO 6270-2 following application of the following protection oils on the layers 13:

Quaker (registered trademark) 6130: weight of the oil film approximately 1 g/m$^2$, and Fuchs (registered trademark) 4107 S: weight of the oil film approximately 1.2 g/m$^2$.

In a test performed in a humidity and temperature controlled corrosion-test chamber in accordance with DIN EN ISO 6270-2, the test pieces are subjected to two aging cycles of 24 hours in a humidity and temperature controlled corrosion-test chamber, i.e., an enclosure with a controlled atmosphere and temperature. These cycles simulate the corrosion conditions of a coil of strip or a strip cut into sheets during storage. Each cycle includes:

a first phase of 8 hours at 40° C.±3° C. and at approximately 98% relative humidity, followed by a second phase of 16 hours at 21° C.±3° C. and at less than 98% relative humidity.

At the conclusion of these cycles, less than 10% of the surface of the test pieces must be visually altered:

after 10 cycles with 1 g/m$^2$ Quaker 6130 oil for French automakers, after 15 cycles with 1.2 g/m$^2$ of Fuchs 4107 S oil for German automakers.

The proportion of altered surface is determined by visual inspection by an operator.

Figure 2:
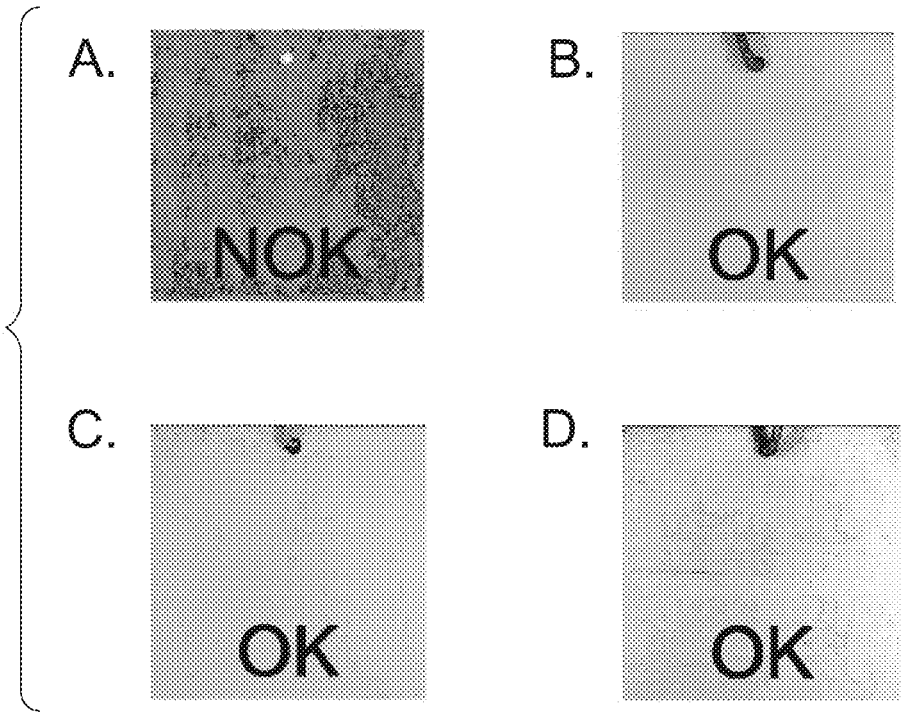
FIGS. 2A to 2D and 3A to 3F are slides that illustrate the results of corrosion tests performed in a humidity and temperature controlled corrosion-test chamber on different steel sheet test pieces treated according to the present invention or untreated.
Figure 3:
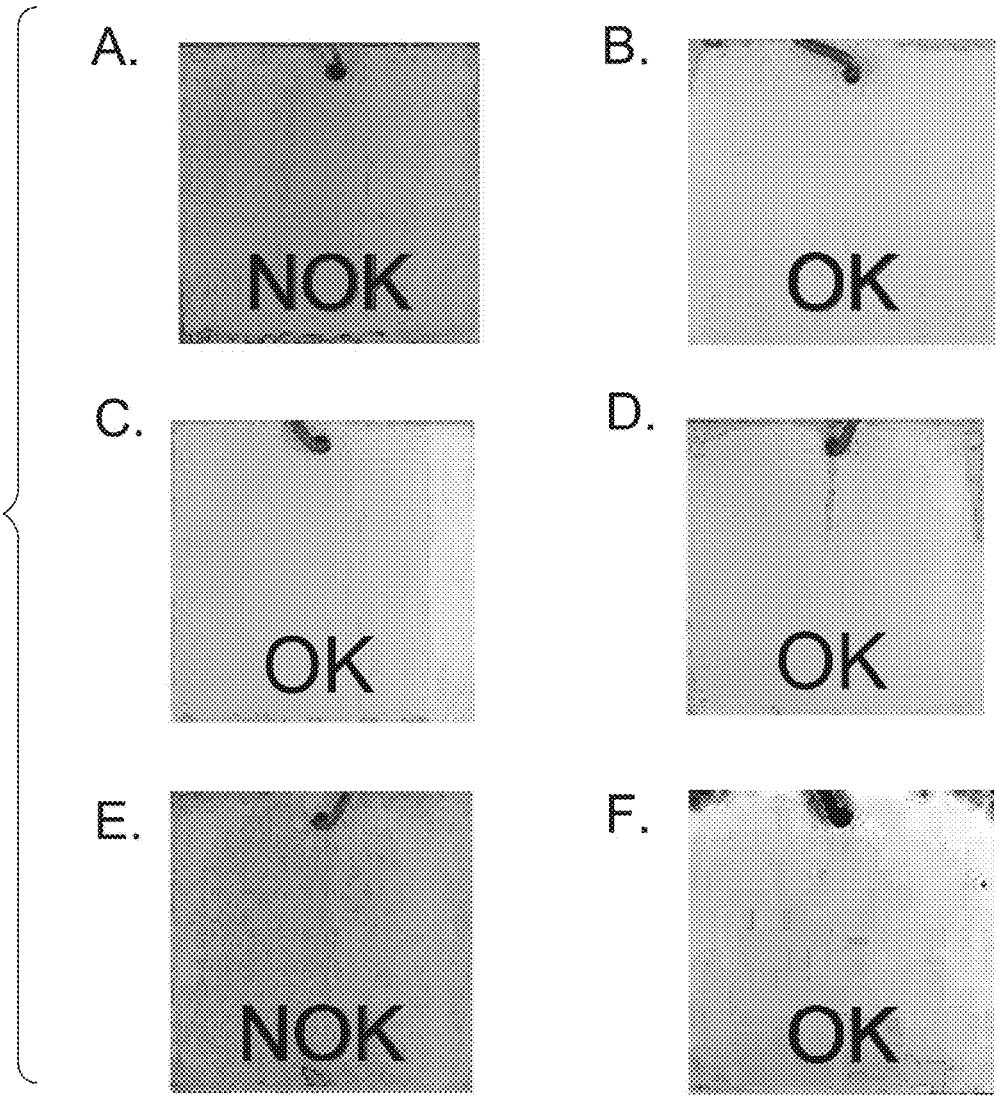

FIG. 2A shows the visual appearance of a ZEMg test piece without a layer 13 after the application of Quaker 6130 oil as described above. This test piece exhibits significant blackening, making it unsuitable for use by French automakers. On the other hand, the ZEMg test pieces with layer 13 (FIGS. 2B to 2D) and after oiling with Quaker 6130 as described above always meet the requirements of the French automakers upon completion of the test.

FIGS. 3A to 3D show the visual appearances, upon completion of the test, of ZnMg Full PVD test pieces without the layer 13 (FIG. 3A) and with the layer 13 (FIGS. 3B to 3D), after the application of Quaker 6130 oil as described above. As shown in these figures, the presence of the layer 13 makes it possible to meet the requirements of the French automakers.

A ZnMg Full PVD test piece without the layer 13 (FIG. 3E) after the application of Fuchs oil as described above, does not meet the requirements of the German automakers, in contrast to a ZnMg Full PVD test piece with the layer 13 (FIG. 3F) after the application of Fuchs oil as described above.

The results of the tests performed in a humidity and temperature controlled corrosion-test chamber have been confirmed by measurements of polarization resistance conducted on the basis of impedance measurement tests and polarization curve tests in a solution of sodium chloride at 5% with a pH of 7.

These measures show that the ZnMg Full PVD test pieces without the layer 13 have a polarization resistance between 160Ω and 380Ω. With a layer 13, this resistance increases to values between 840Ω and 1200Ω, thereby confirming the protective power of the layer 13.

All of the results obtained on the ZnMg Full PVD test pieces show that the layers 13 make it possible to reduce the blackening of sheet 1 with the coating 7 containing zinc and magnesium. This effect is independent of the reduction of the dewetting that the layers 13 make it possible to obtain, as described in application WO-2005/071140. Therefore a coating 7 can be used with a layer 13 without oiling, while preserving effective temporary protection.

Resistance to Tarnishing:

In this case, one configuration of sheet metal 1 has been studied. The coating 7 comprises only one layer 9 with an approximate thickness of 10 μm and contains approximately 3% by weight magnesium, approximately 3.7% by weight aluminum, the remainder consisting of zinc and unavoidable impurities. The substrate 3 is then a cold rolled steel for deep drawing. These test pieces are designated ZnMgAl below.

Products from two different sources corresponding to this configuration were tested and are designated by the references AR 2596 and AR 2598 below.

The temporary protection of the ZnMgAl test pieces was evaluated by means of an aging test under natural exposure conditions under shelter in accordance with standard VDA 230-213 (test length 12 weeks). It was found that the tests performed in a humidity and temperature controlled corrosion-test chamber did not make it possible to reproduce the tarnishing phenomenon observed under natural storage conditions.

The ZnMgAl test pieces were tested oiled (Quaker 6130 film with the weight of approximately 1 g/m$^2$) and unoiled, with and without the layer 13. For purposes of comparison, the same tests were conducted on test pieces cut from standard galvanized sheet with a zinc coating 10 μm thick and a substrate of cold rolled steel for deep drawing. These latter test pieces are designated GI below.

The monitoring of the evolution of the tarnishing during the test was conducted by means of a colorimeter measuring the variation in luminance (measurement of $\Delta L^*$). The threshold value of $|\Delta L^*|$ corresponding to the appearance of tarnishing was set at 2.

Figure 4:
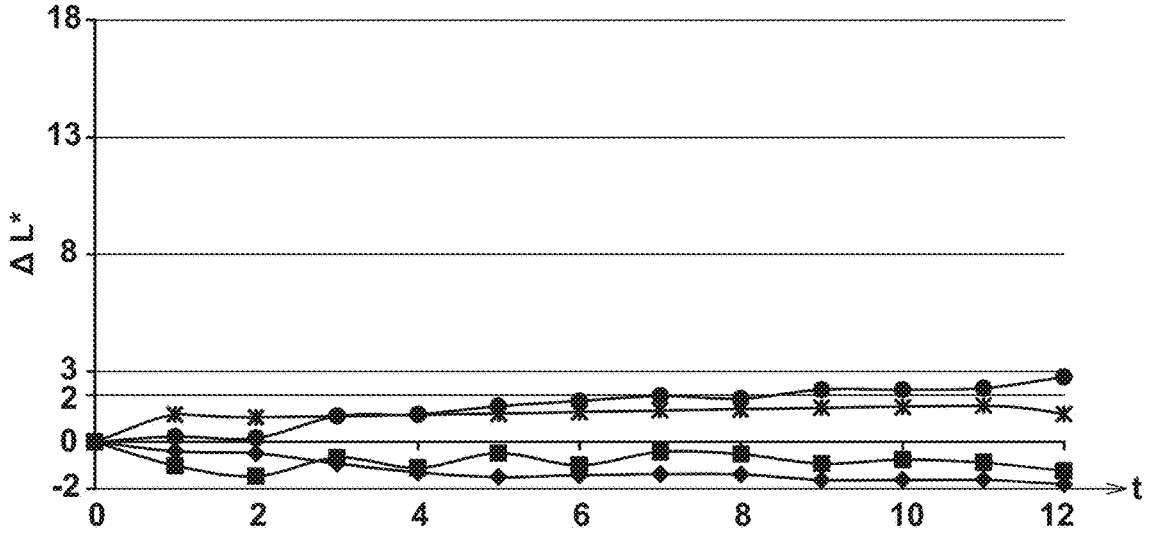
FIGS. 4 to 6 are curves that illustrate the results of aging tests with natural exposure under shelter performed on different sheet metal test pieces treated according to the present invention or not treated.
Figure 5:
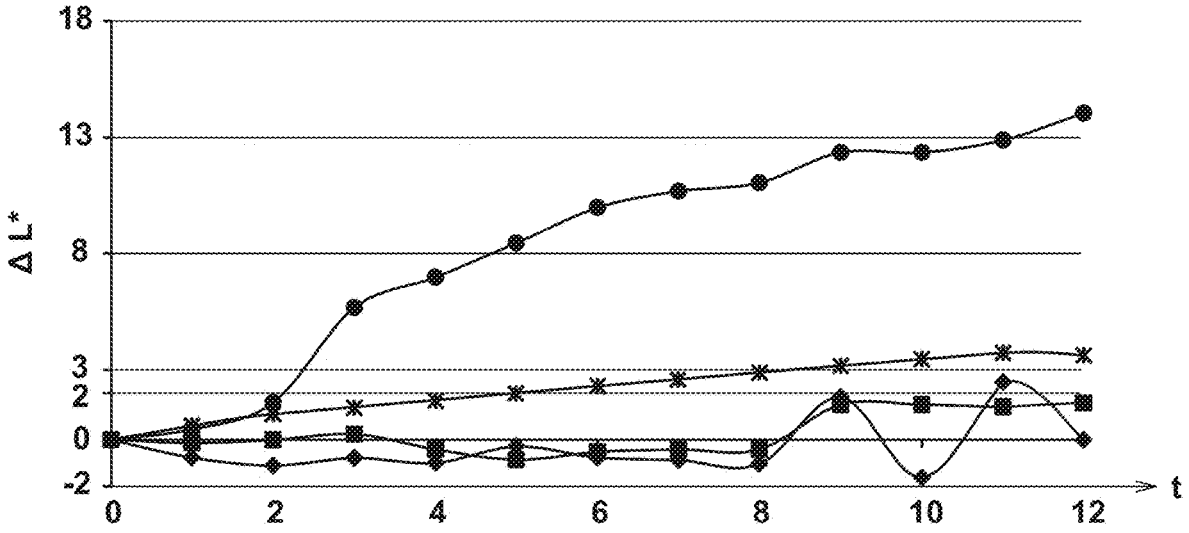
Figure 6:
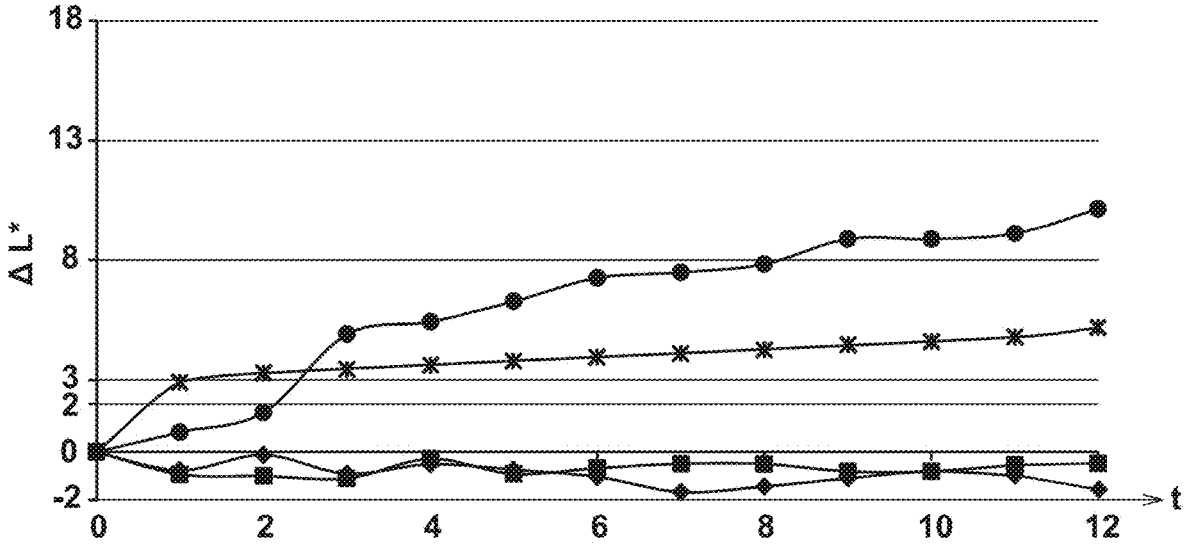

The results obtained for the GI, ZnMgAl AR 2596 and ZnMgAl AR 2598 test pieces are illustrated respectively in FIGS. 4 to 6 where the time in weeks is plotted on the abscissa and the evolution of $\Delta L^*$ is plotted on the ordinates.

The different curves are identified by the following symbols in each of the FIGS. 4 to 6:

•: test pieces without layer 13 and without oiling, x: test pieces without layer 13 but oiled with a film of Quaker 6130 oil with a weight of approximately 1 g/m$^2$, ■: Test pieces with layer 13 and oiled with the film of Quaker 6130 oil with a weight of approximately 1 g/m$^2$, ◆: test pieces with layer 13 without oiling.

These results demonstrate the benefit of the layers 13 for the temporary protection against tarnishing of coatings 7 containing zinc, magnesium and aluminum, because all of the test pieces with a layer 13 have a slower tarnishing kinetic than the test pieces without the layer 13, whether with or without oiling, a finding that also applies for the GI test pieces.

After 12 weeks, the level of tarnishing achieved by the ZnMgAl test pieces with a layer 13 is equivalent to that of the oiled GI test pieces.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A method to reduce blackening or tarnishing of a steel sheet during storage comprising the steps of:

providing an aqueous treatment solution containing sulfate ions $SO_4^{2-}$ in a concentration greater than or equal to 0.01 mol/l;

providing a steel sheet comprising a substrate of steel coated on at least one face with a coating comprising at least zinc and a stabilizing amount of magnesium;

treating the steel sheet with the aqueous treatment solution to form a zinc hydroxysulfate/zinc sulfate-based temporary protection layer on the surface of the treated steel sheet; and stabilizing the zinc hydroxysulfate/zinc sulfate-based temporary protection layer with the stabilizing amount of magnesium in the coating to prevent the transformation of zinc hydroxysulfate to zinc carbonates in the presence of atmospheric $CO_2$ to reduce blackening or tarnishing of the steel sheet during storage; and coiling and storing the treated steel sheet, wherein the treated steel sheet is not oiled prior to coiling and storing.

2. The method recited in claim 1, wherein the coating comprises at least zinc, magnesium and aluminum.

3. The method recited in claim 1, wherein a pH of the aqueous treatment solution is between 5 and 7.

4. The method recited in claim 1, wherein the aqueous treatment solution includes $Zn^{2+}$ ions in a concentration greater than or equal to 0.01 mol/l.

5. The method recited in claim 4, wherein the concentration of $Zn^{2+}$ ions and the concentration of $SO_4^{2-}$ ions in the aqueous treatment solution is between 0.07 and 0.55 mol/l.

6. The method recited in claim 5, wherein the aqueous treatment solution is applied to the coating under conditions of temperature, contact time with the coating, and concentration of $SO_4^{2-}$ ions and $Zn^{2+}$ ions adjusted to form the zinc hydroxysulfate/zinc sulfate-based temporary protection layer having a sulfur content greater than or equal to 0.5 mg/m$^2$ and less than or equal to 30 mg/m$^2$.

7. The method recited in claim 6, wherein the aqueous treatment solution is applied to the coating under conditions of temperature, contact time with the coating, and concentration of $SO_4^{2-}$ ions and $Zn^{2+}$ ions adjusted to form the zinc hydroxysulfate/zinc sulfate-based temporary protection layer having a sulfur content between 3.7 and 27 mg/m$^2$.

8. The method recited in claim 1, further comprising the step of drying the steel sheet.

9. The method recited in claim 1, wherein the aqueous treatment solution is applied under anodic polarization and the pH of the aqueous treatment solution is greater than or equal to 12 and less than 13.

10. The method recited in claim 9, wherein the concentration of $SO_4^{2-}$ ions is greater than 0.07 mol/l.

11. The method recited in claim 9, wherein a density of electric charges flowing during the treatment through the coating is adjusted to form the zinc hydroxysulfate/zinc sulfate-based temporary protection layer, the sulfur content of which is greater than or equal to 0.5 mg/m$^2$ and less than or equal to 30 mg/m$^2$.

12. The method recited in claim 11, wherein the density of electric charges is adjusted to form the zinc hydroxysulfate/zinc sulfate-based temporary protection layer, the sulfur content of which is 3.7 and 27 mg/m$^2$.

13. The method recited in claim 9, wherein a polarization current density applied during the treatment is greater than 20 A/dm$^2$.

14. The method recited in claim 9, further comprising the step of rinsing the steel sheet after the application of the aqueous treatment solution on the coating.

15. The method recited in claim 8, further comprising the step of rinsing the steel sheet before drying the steel sheet.

16. The method recited in claim 1, further comprising the step of forming the steel sheet into a part after treating the steel sheet with the aqueous treatment solution.

17. The method recited in claim 1, wherein the storing is for at least 12 weeks.

18. The method recited in claim 1, wherein the coating comprises zinc and between 0.1 and 20% by weight magnesium.

19. The method recited in claim 18, wherein the coating comprises between 0.1 and 10% by weight magnesium and between 0.1 and 20% by weight aluminum.

20. The method recited in claim 18, wherein the coating comprises between 2 and 4% by weight magnesium and between 2 and 6% by weight aluminum.

21. The method of claim 18, wherein the coating consists essentially of zinc, between 0.1 and 10% by weight magnesium and between 0.1 and 20% by weight aluminum.

22. The method of claim 18, wherein the coating consists essentially of zinc and between 0.1 and 20% by weight magnesium.

23. The method recited in claim 18, wherein the coating consists essentially of zinc, between 2 and 4% by weight magnesium and between 2 and 6% by weight aluminum.

24. The method of claim 18, wherein the coating consists essentially of zinc and between 14% and 18% by weight magnesium.

25. A method to reduce blackening or tarnishing of a steel sheet during storage comprising the steps of:

providing an aqueous treatment solution containing sulfate ions $SO_4^{2-}$ in a concentration greater than or equal to 0.01 mol/l;

providing a steel sheet comprising a substrate of steel coated on at least one face with a coating comprising at least zinc and a stabilizing amount of magnesium;

treating the steel sheet with the aqueous treatment solution to form a zinc hydroxysulfate/zinc sulfate-based temporary protection layer on the surface of the treated steel sheet; and stabilizing the zinc hydroxysulfate/zinc sulfate-based temporary protection layer with the stabilizing amount of magnesium in the coating to prevent the transformation of zinc hydroxysulfate to zinc carbonates in the presence of atmospheric $CO_2$ to reduce blackening or tarnishing of the steel sheet during storage; and storing steel sheet after treating the steel sheet with the aqueous treatment solution for at least 12 weeks, the treated steel sheet not being oiled prior to the step of storing.

26. The method recited in claim 25, wherein the coating comprises at least zinc, magnesium and aluminum.

27. The method recited in claim 25, wherein a pH of the aqueous treatment solution is between 5 and 7.

28. The method recited in claim 25, wherein the coating comprises zinc and between 0.1 and 20% by weight magnesium.

29. The method recited in claim 28, wherein the coating comprises between 0.1 and 10% by weight magnesium and between 0.1 and 20% by weight aluminum.

30. The method recited in claim 28, wherein the coating comprises between 2 and 4% by weight magnesium and between 2 and 6% by weight aluminum.

* * * * *